United States Patent [19]

Kaufman et al.

[11] Patent Number: 4,570,282

[45] Date of Patent: Feb. 18, 1986

[54] TOOTHBRUSH

[76] Inventors: Martin H. Kaufman, 4530 W. Ridgecrest Blvd., Ridgecrest, Calif. 93555; Chris A. Cerceo; Jeanie F. Kaufman, both of 3443 Lake Tahoe Blvd., South Lake Tahoe, Calif. 95705

[21] Appl. No.: 650,814

[22] Filed: Sep. 14, 1984

Related U.S. Application Data

[63] Continuation-in-part of Ser. No. 424,075, Sep. 27, 1982, abandoned, and a continuation-in-part of Ser. No. 451,039, Feb. 22, 1983, abandoned.

[51] Int. Cl.[4] ..... A46B 9/04

[52] U.S. Cl. ..... 15/167 R; 128/62 A

[58] Field of Search ..... 15/167 R, 167 A, 159 A; 128/62 R, 62 A

[56] References Cited

U.S. PATENT DOCUMENTS 569,870 10/1896 Hamilton ..... 15/167 A

FOREIGN PATENT DOCUMENTS 825856 12/1937 France ..... 15/167 A
855253 5/1940 France ..... 15/167 A
1230365 3/1960 France ..... 15/167 A
247005 2/1926 United Kingdom ..... 15/167 A

*Primary Examiner*—Peter Feldman
*Attorney, Agent, or Firm*—Bruce A. Jagger

[57] ABSTRACT

A toothbrush to automatically guide the user to simultaneously clean a tooth surface, the cusps, and the gingival sulcus at approximately 45 degrees. The bristle elements are arranged generally in two banks with the free ends of the bristle elements in the first bank extending convergingly with the free ends of the bristle elements in the second bank to provide a V-shaped tooth receiving channel having an acute included angle of from about 10 to 55 degrees. The bristle elements in the respective banks which are closest together, which is at about the apex of the V-shaped tooth receiving channel, extend into contact with one another at the bristle tips to define therebetween a doublet of mutually supported bristle elements. This doublet provides a stiff cleaning element for the nooks and crannies of the cusps of the teeth.

15 Claims, 6 Drawing Figures

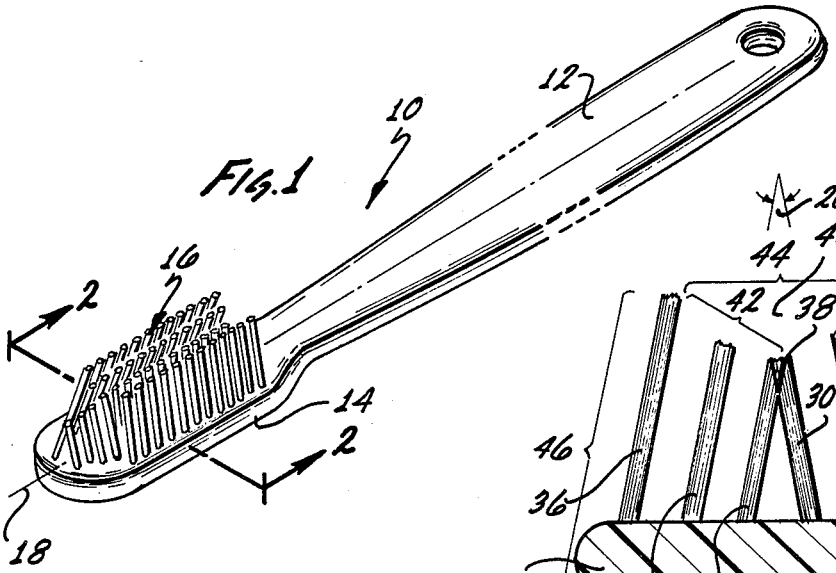
FIG. 1
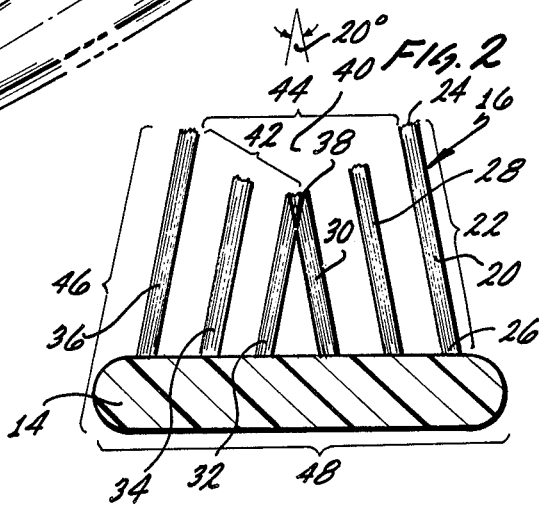
FIG. 2
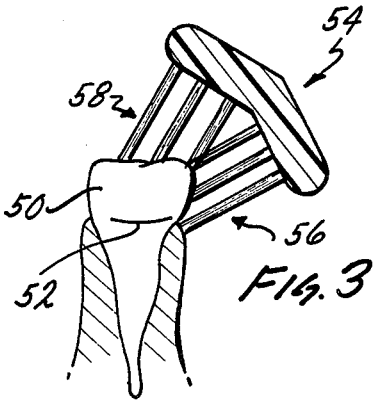
FIG. 3
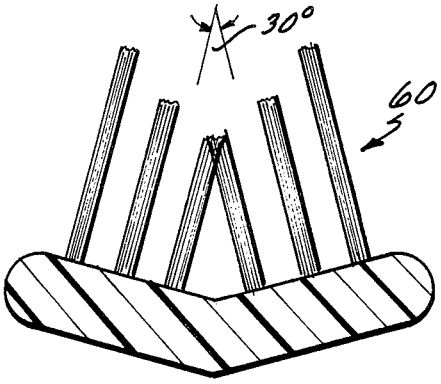
FIG. 4
FIG. 5
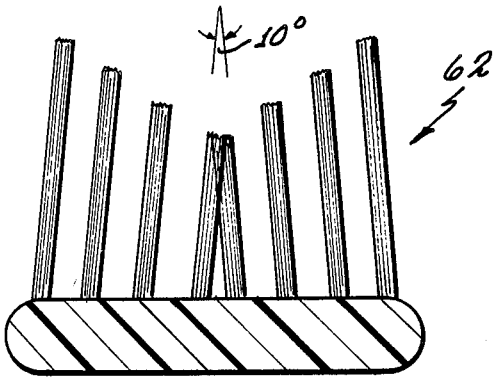
FIG. 6
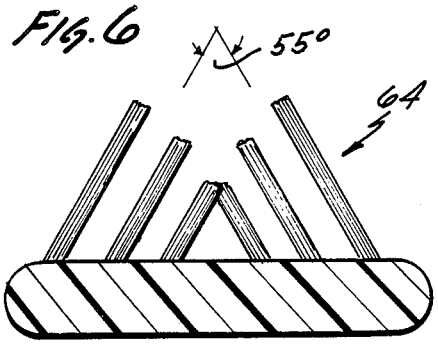

TOOTHBRUSH

BACKGROUND OF THE INVENTION

This application is a continuation in part of application Ser. No. 424,075, filed Sept. 27. 1982, and application Ser. No. 451,039, filed Feb. 22, 1983, both abandoned.

The present invention relates to a toothbrush and more particularly to a toothbrush which is particularly adapted to automatically guide the user to properly position the toothbrush in the mouth for efficient cleaning of the teeth.

Previously considerable difficulty had been experienced in providing a toothbrush which automatically tends to direct the operator to the correct positioning and use of the toothbrush without any prior instruction. Previous attempted expedients generally were incapable of accomplishing the desired result and moreover in some instances tended to risk damage to the teeth or the gums. Prior attempts to develop a toothbrush which would be capable of simultaneously cleaning a tooth surface, the cusps and gingival sulcus simultaneously have generally been wholly unsatisfactory. Further difficulty had previously been experienced in providing a toothbrush which, by reason of structural cooperation between the elements of the brush, would automatically cleanse the gingival sulcus at a bristle contact angle of approximately 45 degrees without any thought or extra effort on the part of the user.

According to the present invention, a toothbrush is provided which is so configured that it prompts efficient proper usage automatically. This objective is achieved with a conveniently sized utensil which is inexpensive to manufacture and convenient to use. The toothbrush according to the present invention comprises an elongated handle and a head element in which bristle elements are embedded. The free ends of the bristle elements are shaped so as to provide a generally V-shaped tooth receiving channel which extends generally parallel with the longitudinal axis of the toothbrush. The surface of the head from which the bristle elements project may be planar or preferably may have a lateral cross section which is generally in the configuration of a shallow V. The bristle elements are generally arranged in columns which extend generally parallel to the longitudinal axis of the head and in rows which extend laterally or transversely across the head. For purposes of description, the bristle elements are shown and discussed as being arranged in columns and rows, even when they are so densely packed that it is difficult to determine the arrangement. The bristle elements are generally arranged in two banks with the bristle elements which provide the free ends that define one side of the generally V-shaped tooth receiving channel being in one bank and the bristle elements which provide the free ends that define the other side of the the generally V-shaped tooth receiving channel being in the other bank. The bristle elements in the respective banks extend generally in a convergent manner so that if extended to the point of contacting one another, they would define therebetween an acute included angle. The bristle elements in the respective banks which are closest together extend into contact with one another at least at the tips to define therebetween a doublet. The doublet, by reason of the mutual support provided by the contact between the bristle elements and the shortness of the bristle elements provides a very stiff cleaning element for the nooks and crannies of the cusps of the teeth. The doublet thus formed is generally positioned at about the apex of the generally V-shaped tooth receiving channel. In a less preferred embodiment the stiff apex cleaning element may be formed by the inclusion of a third bristle element projecting upwardly toward said apex between the respective banks of bristles. Also, in the less preferred embodiment the third bristle element may form the primary stiff apex cleaning element with the bristle tufts from adjacent banks abutting with it, but not each other.

When a toothbrush is in operative position in contact with the teeth, it is preferred that the bristle elements contact the gingival sulcus at a predetermined acute angle of from approximately 35 to 55 degrees, preferably approximately 45 degrees. Medical science has found this to be an optimum cleaning angle for the gingival sulcus. Individuals exert different toothbrush pressures against their teeth, and the bristles are more or less flexible. Predetermining the tooth contacting angle permits the tailor-making of brushes to fit the idiosyncrasies of toothbrush users. The toothbrush of the present invention is structurally proportioned so that when its handle is grasped in the most normal manner by a user, the laterally outermost bristle elements extend to contact the gingival sulcus and the remainder of the bristles in the cleaning surface which is defined by one side of the tooth receiving channel clean the side and cusps of the teeth. One side of the tooth is cleaned at a time. The proportioning of the structure is such that the tooth receiving channel automatically guides the operation of the toothbrush to the most effective and efficient position. While the toothbrush is being operated, one side of the tooth channel acts as the cleaning surface and the other acts as a stop so as to limit the extent to which the bristles extend downwardly along and below the side of the tooth. The cleaning and limiting functions of the respective sides of the tooth receiving channel are reversed when the toothbrush is moved to the other side of the tooth.

A tooth has a front and back surface, a cusp area surface, and two tooth angles, one where the front surface meets the cusp area surface and the other where the rear surface meets the cusp area surface, each at the apex of a tooth angle. When the free ends of the bristles of one bank contact a tooth surface, the bristle ends of the other bank are contacting the cusp area surface and a tooth angle is traversed. The traversed tooth angle acts like a hook or stop or guide rail for the brush during brushing so that the bristle ends of the outermost bristles which are cleaning the front or back tooth surface are held substantially in the vicinity of the gingival sulcus.

In order to accomplish the proper positioning and angular contact with the tooth, it has been found that the bristle elements in the respective banks of bristle elements should extend convergently at an included angle of from about 10 to 55 degrees and preferably from about 20 to 40 degrees. At convergent angles of less than about 10 degrees, the width of the brush across the free ends of the bristle elements becomes so great that it is cumbersome to handle and the proper positioning is difficult to achieve. At convergent angles greater than about 55 degrees, the width across the free end of the bristle elements becomes so small that it is difficult to properly operate the toothbrush.

The bristle elements are preferably defined by bunches of filaments, the individual ones of which have diameters of from approximately 0.15 to 0.4 millimeters and the combined diameter of which is a single tuft or bunch is from approximately 1 to 1.5 millimeters. The bristle elements may be composed of mixtures of individual filaments which have different characteristics. Different bristle elements may have different numbers of filaments. The characteristics of the individual filaments within one tuft or between different tufts may be varied by the selection of filaments composed of different materials or different diameters or materials which have different physical characteristics due to different previous treatments. Within a single toothbrush the characteristics may be varied from one bristle element to another so that, for example, the bristle elements which are laterally outermost may be softer and less erosive in their action than those bristle elements which are closer to the apex of the tooth receiving channel. In general, increasing the length of a bristle element increases the softness of the cleaning action and decreases the erosiveness of the bristle element. If desired, some or all of the bristle elements may be tapered towards their free ends and the free ends may be polished. In general, the advantageous results according to the present invention are achieved utilizing no more than three or four bristle elements per row in each bank of bristle elements.

People exert different toothbrush pressures on their teeth. Those people who prefer to press the brush hard against the teeth generally prefer to feel the effect. The outermost bristles of their brush may be polished, but when all are substantially of one length, they can feel the bristle free ends spread as they press the brush against the teeth. In that case it is preferable that in the outermost columns the bristle elements be tapered. Tapering is conveniently accomplished by cutting the individual filaments within a given bristle element to different lengths ranging from the full intended length of the outermost bristle to about 60 percent of that length. Because of the inherent characteristic that the bristle elements tend to become harsher in their cleaning action as the length of the bristle element decreases, it is generally undesirable to decrease the length of the shortest bristles in the doublet at the apex of the tooth receiving channel to less than approximately one quarter and preferably not less than approximately one third of the length of the laterally outermost bristle elements. It has been found possible to increase the length of the cleaning surface in the tooth receiving channel without decreasing the length of the bristle elements in the doublet by forming the base which supports the bristle elements into a generally V-shaped configuration. The bristle elements in the doublet project generally from the vicinity of the apex of the shallow V-shaped base member. Decreasing the obtuse angle of the generally V-shaped base to less than approximately 120 degrees results in increasing the overall height of the brush to the point where it becomes generally uncomfortable and awkward to use. Generally the obtuse base angle will be within the range of about 125 degrees to 170 degrees. Above about 170 degrees the width of the brush becomes so large as to be cumbersome and awkward to use.

The toothbrush according to the present invention is preferably constructed in a variety of sizes to accommodate different tooth sizes in children and adults. The proportions between the various elements in the toothbrush remain about the same, while the absolute sizes are changed to accommodate different tooth and mouth sizes. In general, the length of the laterally outermost bristle elements range from about 9 to 15 millimeters in length and preferably are approximately 11 millimeters in length for the average adult size, and from about 4 to 10 millimeters for pediatric sizes and preferably approximately 8 millimeters for the pediatric brushes. The bristle elements which define the doublet generally have a length of from about one quarter to seven tenths, and preferably from one third to one half that of the laterally outermost bristle elements. The lateral width of the opening of the tooth receiving channel ranges from about one quarter to that of the length of the outermost bristle element, and preferably one third to three quarters of the length of the outermost bristle element. Below this range, the user sometimes encounters difficulty in easily inserting the teeth into the tooth receiving channel. For widths greater than this range, the toothbrush tends to become somewhat less self-positioning in the operating position. The overall height of the operating portion of the brush is generally no more than approximately one and one half that of the length of the laterally outermost bristle element, while the overall width is no more than approximately twice, and preferably no more than one and seven tenths, that length. Values for the overall height and width which are greater than this tend to produce a structure which is so bulky as to be uncomfortable and difficult to use.

In one preferred embodiment it has been found that at a convergent angle of about 22 degrees, an overall height of about 18 millimeters, an overall width of about 22 millimeters, a laterally outermost bristle length of about 11 millimeters and a doublet bristle element length of about 5 millimeters produces a very satisfactory result when three bristle elements are provided in each row of each bank. Bristle elements in this preferred embodiment comprise bristle tufts in which the filaments have a diameter of about 0.18 millimeters and the diameter of the bristle tufts is approximately 1.5 millimeters. The distance between the attached ends of the doublet bristle elements is approximately 2.5 millimeters and the doublet bristle elements abut one another for a substantial portion of their length adjacent to the free ends. The base member in which the bristle elements are embedded has a generally shallow V-shaped configuration with an obtuse angle at the apex of about 140 degrees. The base is about 5 millimeters thick. In general, the overall height of the operative portion of the toothbrush is from about 10 to 20 and preferably 12 to 18 millimeters. The overall width of the operative portion of the toothbrush is generally from about 14 to 24 and preferably 16 to 22 millimeters. The head element in which the bristle elements are embedded is a unitary structure consisting of a single member. The unitary nature of this structure promotes the strength and the cleanliness of the utensil, as well as tending to keep its size within the necessary ranges. In general, the abutting bristle elements abut one another for approximately one eighth to one half of their length adjacent to their free ends with preferably at least one quarter of such length being in such contact so as to provide additional support and stiffening for the doublet. The resultant stiffness and resistance to deformation contributes significantly to the cleaning ability of the brush insofar as the nooks and crannies of the cusps are concerned.

The distance between the affixed ends of the bristle elements which form the doublet can approach zero whereby a triangularlike zone substantially of bristles can be formed. This is particularly useful for cusps having deep grooves. If the distance between the affixed ends of the bristle elements which form the doublet get much larger than about three tuft diameters, the effectiveness of the doublet for cleaning the cusp area decreases as abutting tufts become less supportive of each other. The preferred distance between the affixed ends of the doublet is about one half to two tuft diameters with the bristle elements substantially in continual lateral succession in each row through both banks, there being no large gaps in the succession, particularly in the vicinity of the apex of the base member. The bristle elements can be substantially equally spaced both laterally and longitudinally with the affixed ends of abutting tufts being generally about one-half tuft diameter apart. The tufts or bunches can be positioned closer and closer together, approaching the close packed geometry of paint brushes. The close packed geometry can be beneficial in brushing the teeth as an increased number of bristle free ends contact a tooth surface during brushing.

Referring particularly to the drawings for the purposes of illustration only and not limitation, there is illustrated:

FIG. 1, a perspective view of a preferred embodiment of a toothbrush according to the present invention;

FIG. 2, a cross-sectional view taken along line 2—2 in FIG. 1;

FIG. 3, a cross-sectional view of a further embodiment in operative position adjacent to a tooth;

FIG. 4, a cross-sectional view of a further embodiment similar to the embodiment illustrated in FIG. 3 illustrating an acute included angle of approximately 30 degrees;

FIG. 5, a cross-sectional view of a further embodiment illustrating an acute included angle of approximately 10 degrees; and FIG. 6, a cross-sectional view of a further embodiment illustrating an acute included angle of approximately 55 degrees.

Referring to the drawings, there is illustrated generally at 10 a toothbrush according to the present invention which comprises a handle 12 for grasping and a head 14 which is provided with a plurality of bristle elements 16 for the purposes of providing a cleaning surface to clean teeth. A longitudinal axis 18 extends longitudinally through toothbrush 10.

Head 14 mounts a plurality of bristle elements. The laterally outermost bristle element 20, as illustrated particularly in FIG. 2, has a length indicated at 22 between its outer free end 24 and its fixed end 26, which is embedded in head 14. Laterally, outermost bristle element or tuft 20, together with intermediate bristle tuft 28 and laterally innermost bristle tuft 30 define one row of a bank of bristle elements. Similarly, laterally innermost bristle tuft 32, intermediate bristle tuft 34 and laterally outermost bristle tuft 36 define one row of a second bank of bristle elements. Bristle tufts 30 and 32 together define doublet 38. A tooth receiving channel 40 is defined by the free ends of the respective bristle tufts in the two banks. The length of an operative cleaning surface defined by the respective free ends is indicated generally at 42 and extends from the free end of bristle tuft 36 to the free end of doublet 38. The lateral width of tooth receiving channel 40 is indicated generally at 44. The overall height of the brushing member, which includes head 14 and the respective bristle tufts, is indicated generally at 46, while the overall width of the structure is indicated generally at 48.

The further embodiment of the toothbrush, which has a generally shallow V-shaped cross-sectional base, is indicated generally at 54 in operative position relative to tooth 50 and gingival sulcus 52. The bristle elements in embodiment 54 are arranged in first bank 56 and second bank 58. As illustrated particularly in FIG. 3, the cleaning surface is provided by the free ends of first bank 56, while the second bank 58 provides a stop for the purposes of guiding the toothbrush 54 in the proper operative position.

Referring particularly to FIG. 4, there is illustrated generally at 60 a further embodiment in which the individual bristle elements extend generally normal to the surface of the base from which they project. The convergent angle of approximately 30 degrees is provided by the shallow V configuration of the base.

Referring particularly to FIG. 5, there is illustrated generally at 62 an additional embodiment of the invention wherein four bristle tufts are provided in each row of each bank of bristle elements. The bristle elements project angularly from the generally planar surface of the base in which they are embedded. The convergent angle of the bristle elements in the respective banks is approximately 10 degrees.

Referring particularly to FIG. 6, there is illustrated generally at 64 a further embodiment of the invention in which the bristle tufts are embedded in a generally planar base and extend at a convergent angle of approximately 55 degrees.

What have been described are preferred embodiments in which modifications and changes may be made without departing from the spirit and scope of the accompanying claims.

What is claimed is:

1. A toothbrush comprising:

means for grasping;

means for brushing mounted on said means for grasping and including an elongated base element having a longitudinal axis and mounting a plurality of bristle elements for cleaning teeth extending generally transversely to said longitudinal axis, one end of said bristle elements being affixed to said base element and the other end of said bristle elements being free, said free ends defining together a tooth receiving channel means for receiving a tooth and guiding said means for brushing so that said free ends on one side of said channel means contact the side of a tooth at an angle of from approximately 35 to 55 degrees, said tooth receiving channel means having generally a V-shaped configuration, said bristle elements being arranged generally in two banks with the free ends of said bristle elements in a first bank extending convergingly with the free ends of said bristle elements in a second bank at an acute included angle of from about 10 to 55 degrees, the portion of said base element to which said first bank of bristle elements is affixed being continuous with and immovable with respect to the portion of said base element to which said second bank of bristle elements is affixed, the bristle elements in each said bank being arranged generally in rows, said rows extending substantially transversely to said longitudinal axis with the laterally innermost bristle elements of the rows in each of said banks abutting one another for at least approximately one eight of their length adjacent to said free ends to form a doublet, the free ends of said abutting bristle ends being located at about the apex of said tooth receiving channel means, the laterally outermost ones of said bristle elements having a first length, the bristle elements forming said doublet having a length of from about one quarter to one half that of said first length, the lateral width of the opening of said tooth receiving channel means being from about one third to three quarters that of said first length, the overall height of said means for brushing being no more than approximately one and one half that of said first length, the overall width of said means for brushing being no more than approximately twice said first length.

2. A toothbrush of claim 1 wherein the laterally outermost ones of said bristle elements have a first length of from about 9 to 15 millimeters.

3. A toothbrush of claim 1 wherein the laterally outermost ones of said bristle elements have a first length of about 11 millimeters.

4. A toothbrush of claim 1 wherein said acute included angle is from about 20 to 40 degrees.

5. A toothbrush of claim 1 wherein said rows within one said bank include three bristle elements.

6. A toothbrush of claim 1 wherein said elongated base element has a generally shallow V-shaped lateral cross section with said bristle elements extending generally normal to the surface of said base from which they extend.

7. A toothbrush of claim 1 wherein said elongated base element has a generally planar surface where said bristle elements are affixed to said base, said bristle elements extending generally angularly to said generally planar surface.

8. A toothbrush of claim 1 wherein said bristle elements comprise bristle tuft elements containing a plurality of filaments having diameters of from about 0.15 to 0.4 millimeters.

9. A toothbrush of claim 1 wherein the bristle elements forming said doublet have a length of approximately one third that of said first length, the lateral width of the opening of said tooth receiving channel means being approximately one half that of said first length, the overall height of said means for brushing being from about 12 to 18 millimeters, the overall width of said means for brushing being from about 18 to 22 millimeters and said acute included angle being from about 20 to 40 degrees.

10. A toothbrush of claim 1 wherein said elongated base element comprises a unitary structure.

11. A toothbrush of claim 1 wherein said laterally innermost bristle elements of said first bank abut said laterally innermost bristle elements of said second bank for at least approximately one quarter of their length.

12. A toothbrush comprising:

means for grasping;

means for brushing mounted on said means for grasping and including an elongated base element having a longitudinal axis and mounting a plurality of bristle elements for cleaning teeth extending generally transversely to said longitudinal axis, one end of said bristle elements being affixed to said base element and the other end of said bristle elements being free, said free ends defining together a tooth receiving channel means for receiving a tooth and guiding said means for brushing so that said free ends on one side of said channel means contact the side of a tooth at a predetermined acute angle, said tooth receiving channel means having generally a V-shaped configuration, said bristle elements being arranged generally in two banks with the free ends of said bristle elements in a first bank extending convergingly with the free ends of said bristle elements in a second bank at an acute included angle of from about 10 to 55 degrees, said base element being unbroken between said banks and supporting said bristle elements in fixed relationship to one another, the bristle elements in each said bank being arranged generally in rows, said rows extending substantially transversely to said longitudinal axis, bristle means for defining a stiff apex cleaning element, said bristle means including the laterally innermost bristle elements of the rows in each of said banks, said laterally innermost bristle elements in said first and second banks abutting one another for at least approximately one quarter of their length, the laterally outermost ones of said bristle elements having a first length, the bristle elements forming said stiff apex cleaning element having a length of from about one quarter to seven tenths that of said first length.

13. A toothbrush of claim 12 wherein the laterally outermost ones of said bristle elements have a first length of from about 4 to 10 millimeters.

14. A toothbrush of claim 12 wherein the laterally outermost ones of said bristle elements have a first length of approximately 8 millimeters.

15. A toothbrush of claim 12 wherein said bristle elements have a generally uniform spacing of about one-half bristle element diameter.

* * * * *